US005720671A

United States Patent [19]

Cheng

[11] Patent Number: 5,720,671

[45] Date of Patent: Feb. 24, 1998

[54] COMPOSITE GOLF CLUB SHAFT AND METHOD OF MAKING THE SAME

[75] Inventor: Michael H. L. Cheng, Simi Valley, Calif.

[73] Assignee: Harrison Sports, Inc.

[21] Appl. No.: 707,646

[22] Filed: Sep. 5, 1996

[51] Int. Cl.[6] ..... A63B 53/02; A63B 53/10

[52] U.S. Cl. ..... 473/305; 473/319; 273/DIG. 7; 273/DIG. 23

[58] Field of Search ..... 473/319, 305–323; 273/DIG. 23, DIG. 7

[56] References Cited

U.S. PATENT DOCUMENTS

| | | | |
|---|---|---|---|
| 1,639,864 | 8/1927 | Smith . | |
| 1,653,428 | 12/1927 | Brinkman | 473/316 |
| 1,713,812 | 5/1929 | Barnhart . | |
| 2,050,554 | 8/1936 | Barnhart | 473/323 |
| 2,086,275 | 7/1937 | Lemmon . | |
| 2,153,550 | 4/1939 | Cowdery . | |
| 2,250,441 | 7/1941 | Vickery | 473/323 |
| 3,083,969 | 4/1963 | Bills . | |
| 3,313,541 | 4/1967 | Benkoczy et al. . | |
| 3,614,101 | 10/1971 | Hunter . | |
| 3,998,458 | 12/1976 | Inoue et al. . | |
| 4,000,896 | 1/1977 | Lauraitis . | |
| 4,043,074 | 8/1977 | Airhart . | |
| 4,157,181 | 6/1979 | Cecka . | |
| 5,088,735 | 2/1992 | Shigetoh . | |
| 5,093,162 | 3/1992 | Fenton et al. . | |
| 5,156,396 | 10/1992 | Akatsuka et al. . | |
| 5,251,896 | 10/1993 | Gerlach | 473/319 |
| 5,265,872 | 11/1993 | Tennent | 273/DIG. 23 |
| 5,294,119 | 3/1994 | Vincent et al. . | |
| 5,335,909 | 8/1994 | Green | 473/305 |

FOREIGN PATENT DOCUMENTS

| | | |
|---|---|---|
| 465414 | 5/1937 | United Kingdom . |

*Primary Examiner*—Sebastiano Passaniti
*Assistant Examiner*—Stephen L. Blau
*Attorney, Agent, or Firm*—Oppenheimer Poms Smith

[57] ABSTRACT

A golf club shaft including a base rod and a hosel section of a substantially uniform predetermined thickness extending radially outwardly from a portion of club head end of the base rod. The length of hosel section is substantially greater than the length of the club head hosel recess into which the shaft will be inserted.

33 Claims, 2 Drawing Sheets

COMPOSITE GOLF CLUB SHAFT AND METHOD OF MAKING THE SAME

BACKGROUND OF THE INVENTION

1. Field of Invention

The present invention relates generally to golf clubs and, more particularly, to composite resin/fiber golf club shafts.

2. Description of the Related Art

Over the years, many substitutes have been introduced for the hard wood shafts originally used in golf club drivers and irons. Early substitute materials included stainless steel and aluminum. More recently, carbon fiber reinforced resin shafts have become popular. Such shafts are typically hollow and consist of a shaft wall formed around a tapered mandrel. The use of fiber reinforced resin has allowed golf club manufacturers to produce shafts having varying degrees of strength, flexibility and torsional stiffness. As such, manufacturers are able to produce shafts which suit the needs of a wide variety of golfers.

One disadvantage of conventional fiber reinforced resin shafts is their tendency to crack and/or break, especially at or near the point at which the shaft enters the hosel of the golf club head. One proposed solution has been to simply increase the thickness of the shaft wall in order to increase the strength and torsional rigidity of the shaft. These so-called "thick" shafts tend to be too heavy and stiff for the majority of golfers. Another proposed solution is to construct the club head end of the shaft such that the thickness of the shaft wall increases from the shaft tip to a maximum thickness at or near the point at which the shaft enters the hosel of the club head and then decreases from this point of maximum thickness until the wall thickness of the shaft is that of the base rod, which forms the remaining portion of the shaft.

SUMMARY OF THE INVENTION

The inventor herein has discovered that one disadvantage associated with placing this point of maximum shaft wall thickness at or near the point of entry into the club head hosel, and then reducing the thickness of the wall on both sides of this point of maximum thickness is the formation of a stress riser in the location at which most clubs crack or break, i.e. the shaft/hosel junction.

Accordingly, the general object of the present invention is to provide a golf club shaft which eliminates, for practical purposes, the aforementioned problems. In particular, one object of the present invention is to provide a golf club shaft which is less likely to crack or break than conventional shafts. Another object of the present invention is to provide a golf club shaft which reduces the likelihood of cracks and breaks without substantially increasing the weight and stiffness of the shaft. Still another object of the present invention is to provide a golf club shaft that is lighter than conventional golf club shafts having the same structural rigidity. Still another object of the present invention is to provide a golf club shaft that does not have a stress riser at or near the point at which the shaft enters the hosel of the golf club head.

In order to accomplish these and other objectives, a preferred embodiment of the present invention includes a base rod and a hosel section of a substantially uniform predetermined thickness extending radially outwardly from a portion of the base rod at the shaft's club head end. The length of hosel section is substantially greater than the length of the club head hosel recess into which the shaft will be inserted. The present invention provides a number of advantages over the prior art. For example, the present invention provides additional torsional rigidity and strength at the top of the club head hosel, while the substantial majority of the rod remains relatively thin and lightweight. Moreover, the present invention does so without creating a stress riser at the shaft/club head junction.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
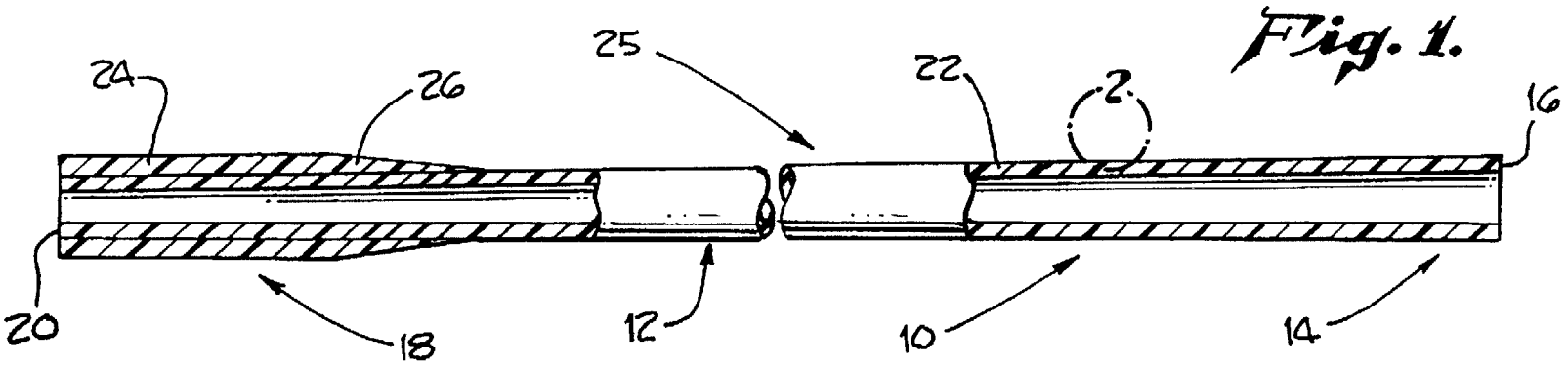
FIG. 1 is a section view of a golf club shaft in accordance with a preferred embodiment of the present invention.

As illustrated for example in FIG. 1, a golf club shaft 10 in accordance with a preferred embodiment of the present invention includes base rod 12 having a grip portion 14 associated with longitudinal end 16 and a club head portion 18 associated with longitudinal end 20. The base rod 12 is preferably hollow and, although base rod wall 22 has a substantially uniform thickness along its length, tapers so as to slightly increase in outer diameter from longitudinal end 20 to longitudinal end 16. The taper of the base rod's hollow interior permits withdrawal of the base rod from the mandrel on which it is formed. The shaft 10 also includes a hosel section 24 formed over the club head portion 18 of the base rod 12 and a flare section 26 adjacent to the hosel section. The hosel section 24 is preferably of uniform thickness along its length and, therefore, tapers in the same manner as the base rod 12. As discussed in greater detail below, and in accordance with the exemplary embodiment, the length of the hosel section 24 is such that the hosel section will extend substantially beyond the top of the hosel recess of the club head in which the shaft will be mounted. The shaft will, therefore, include an area of increased shaft wall thickness which extends beyond the top of the hosel recess of the club head, but only partially along the entire length of the shaft.

Figure 2:
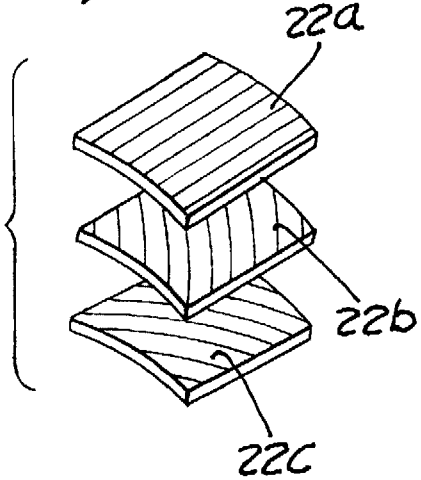
FIG. 2 is an exploded isometric view of the portion of the preferred embodiment identified by circle 2 in FIG. 1.

The base rod 12 may be formed by wrapping multiple layers (typically 10–20 layers) of a fiber reinforced resin composite over the mandrel until the desired thickness of wall 22 is obtained. As shown by way of example in FIG. 2, the fibers of each successive base rod layer 22*a*, 22*b* and 22*c* are preferably oriented at different angles with respect to the longitudinal axis of the base rod 12. The fibers of layer 22*a* are parallel to the longitudinal axis of the base rod, while the fibers of layers 22*b* and 22*c* are angled from 30–90 degrees with respect to the longitudinal axis. It should be noted, however, that the fibers of successive base rod layers, such as the outer layers, may be parallel to one another. Other layer combinations are also possible. For example, the first 5 to 10 layers may be alternating angled layers such as layers 22*b* and 22*c*, and the next 5 to 10 layers may be parallel to the longitudinal axis such as layer 22*a*.

Figure 3:
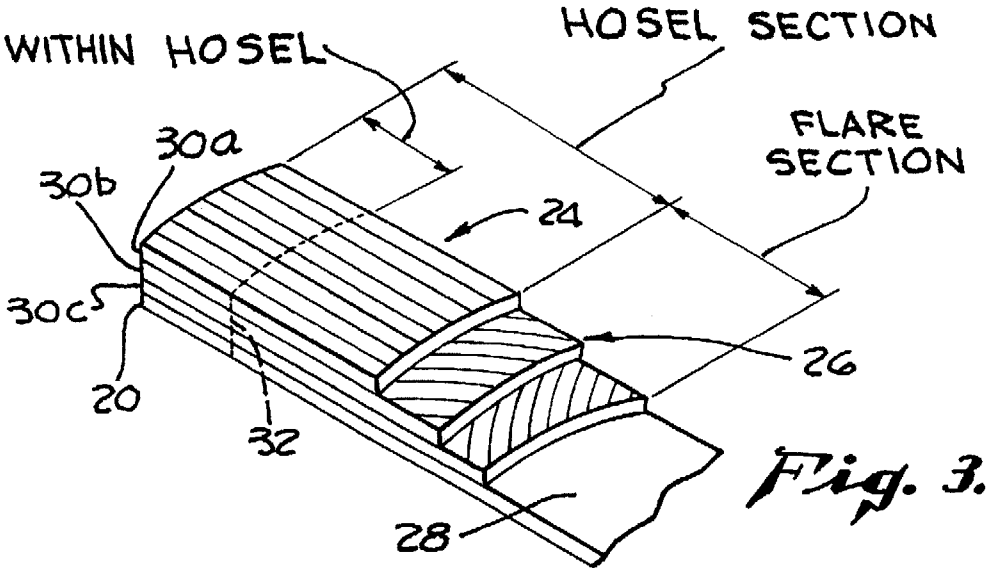
FIG. 3 is an isometric view of a portion of the preferred embodiment illustrated in FIG. 1.

Turning to the club head portion 18 of the exemplary shaft 10 shown in FIG. 3, the hosel section 24 may be formed on the base rod by applying one or more layers of a fiber reinforced resin composite over the base rod top surface 28, thereby increasing the wall thickness of the shaft in this particular area. It is noted here that the descriptive term "club head portion" is used herein to describe the portion of the base rod 12, as well as the portion of the completed golf club shaft 10, that is to be at least partially inserted into a golf club head. In the preferred embodiment, the hosel section 24 is formed by successively applying hosel section layers 30*a*, 30*b* and 30*c* with the fibers of each layer oriented in the manner described in the preceding paragraph. One end of each of the hosel section layers is aligned (or flush) with the base rod longitudinal end 20. The total number of layers is preferably 10–20. However, this number may be varied as desired.

In accordance with the preferred embodiment, hosel section layer 30*b* is longer than hosel section layer 30*a* and hosel section layer 30*c* is longer than hosel section layer 30*b*. The length of hosel section 24 is defined by the length of layer 30*a*. Layers 30*b* and 30*c*, which extend beyond the end of layer 30*a*, form the flare section 26. By way of example, when the shaft is used in conjunction with a club head having a hosel recess that is 1 and ½ inches deep, the length of hosel section layers 30*a*, 30*b* and 30*c* may be 4, 5, and 6 inches, respectively. As such, the length of hosel section 24 will be four inches and the length of the flare section 26 will be two inches. Moreover, the hosel section 24 will extend 2 and ½ inches beyond the shaft/club head junction 32 (shown with dotted lines) formed at the top of the club head's hosel recess.

With respect to the other significant dimensions of the exemplary embodiment, the overall length of the shaft is preferably between 39 and 50 inches, the diameter at end 16 is approximately 0.6 inches, and the diameter at end 20 is between approximately 0.335 inches and approximately 0.370 inches. The thickness of base rod wall 22 is approximately 0.07 inches and the thickness of hosel section is approximately 0.02 inches. Any of these dimensions (as well as the number of layers used to form the base rod and hosel section) may be varied to suit the particular needs and desires of individual golfers. Also, it should be noted that if the thickness of the entire shaft was increased by 0.02 inches, as opposed to only over the length of the hosel section 24 as in the present invention, the weight of a graphite reinforced shaft would be increased by more than 20 g.

The present invention may be practiced with any of the materials typically used to produce composite resin/fiber golf club shafts. Suitable resins include, for example, thermosetting resins or polymers such as polyesters, epoxies, phenolics, melamines, silicones, polimides and polyurethanes. Suitable fibers include, for example, carbon-based fibers such as graphite, glass fibers, aramid fibers, and extended chain polyethylene fibers. After the base rod 12, hosel section 24 and flare section 26 are formed by wrapping successive layers of fiber reinforced resin, the shaft 10 is cured (either completely or partially) in an oven. Curing times and temperatures depend on the polymer used in the composite and are well known to those of skill in the art.

Figure 4:
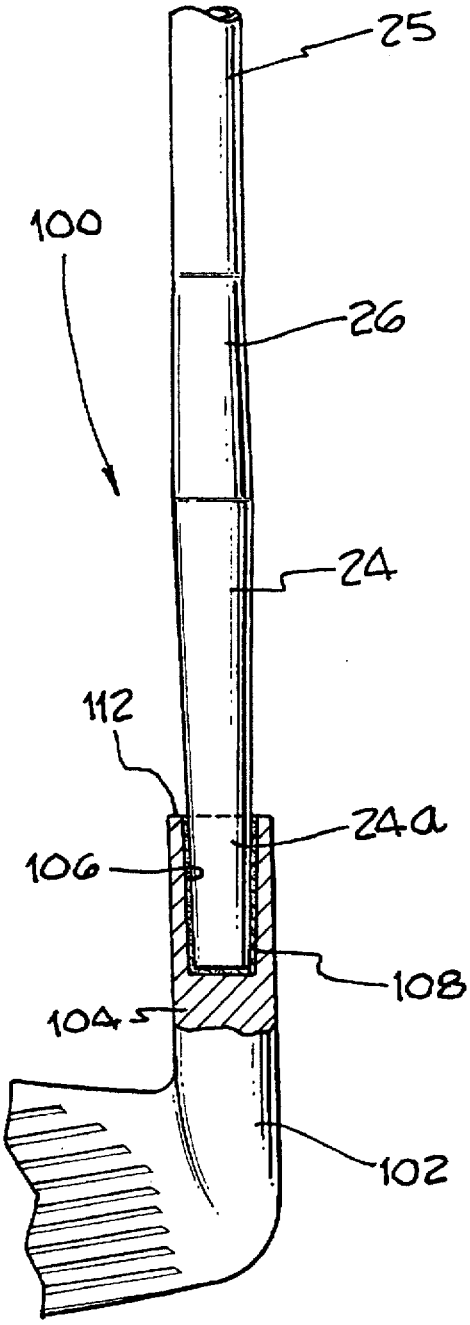
FIG. 4 is a partial section view of a golf club in accordance with a preferred embodiment of the present invention.

Referring to FIG. 4, an exemplary golf club 100 in accordance with the present invention includes the shaft 10 and a club head 102. The club head 102 includes a hosel 104 having a recess 106. A relatively smaller portion 24*a* of the shaft's hosel section 24 is held within the recess by, for example, an adhesive 108. Accordingly, the shaft wall includes a relatively thicker area at the top 112 of the club head hosel, the spot at which golf clubs are most likely to crack or break. The outer diameter continues to increase to the end of the flare section 26 (although the wall thickness remains uniform up to the end of the hosel section 24) and the remainder 25 of the shaft is simply the relatively thin walled base rod 12. As a result, and as also shown in FIG. 1, additional torsional rigidity and strength are provided at the top of the club head hosel, while the substantial majority of the rod remains relatively thin and lightweight.

Figure 5A:
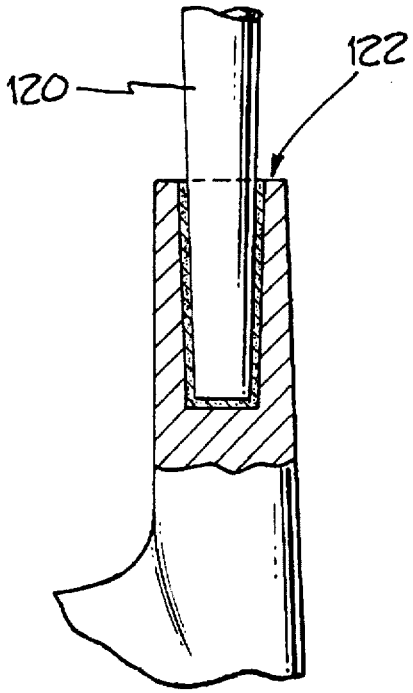
FIG. 5*a* is a partial section view of a conventional golf club.
Figure 5B:
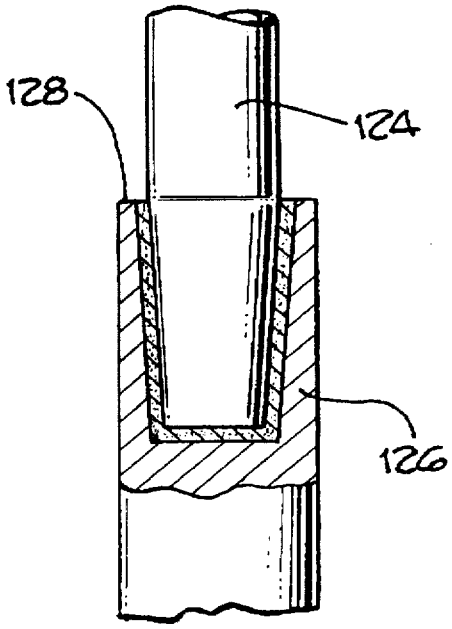
FIG. 5*b* is a partial section view of another conventional golf club.

Compare the novel shaft configuration shown in FIG. 4 to the conventional configuration shown in FIG. 5*a*, which consists solely of a base rod 120. The only way to increase the strength of this shaft at the shaft/club head hosel junction 122 is to increase the wall thickness of the entire shaft, thereby increasing the weight and stiffness of the shaft to an undesirable level. Turning to the conventional shaft shown in FIG. 5*b*, the portion 124 of the shaft associated with the club head hosel 126 increases in wall thickness (and diameter) up to a point (shown with dotted lines) adjacent to the top 128 of the club head hosel and then decreases in thickness (and diameter) from there. The inventor herein has concluded that this configuration creates a stress riser near the top 128 of the club head hosel which, as noted above, is the spot at which golf clubs are most likely to crack or break. The present invention does not create a stress riser at this location.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A golf club shaft for use with a golf club head, the golf club head including a hosel having a recess formed therein, the recess defining a hosel recess length, the golf club shaft comprising:

a base rod defining a grip portion associated with a first longitudinal end, and a club head portion associated with a second longitudinal end; and a hosel section extending radially outwardly from a portion of the base rod, the hosel section defining a first end located between the first and second longitudinal ends of the base rod and a second end located substantially adjacent to the second longitudinal end of the base rod, the first and second ends of the hosel section defining a hosel section length therebetween, the hosel section having a substantially uniform predetermined thickness over the hosel section length, and the hosel section length being substantially greater than the hosel recess length.

2. A golf club shaft as claimed in claim 1, wherein the base rod comprises a plurality of base rod layers of a composite of a polymer reinforced internally by parallel elongate fibers and the hosel section comprises at least one hosel section layer of a composite of a polymer reinforced internally by parallel elongate fibers.

3. A golf club shaft as claimed in claim 2, wherein the parallel elongate fibers in one base rod layer extend in a substantially different direction than the parallel elongate fibers in an adjacent base rod layer.

4. A golf club shaft as claimed in claim 2, wherein the hosel section comprises a plurality of hosel section layers and the parallel elongate fibers in one hosel section layer extend in a substantially different direction than the parallel elongate fibers in an adjacent hosel section layer.

5. A golf club shaft as claimed in claim 4, wherein the base rod defines a longitudinal axis, the hosel section comprises at least first, second and third hosel section layers, the parallel fibers of the first hosel section layer are disposed at an angle substantially between approximately thirty degrees and approximately ninety degrees measured from the longitudinal axis of the base rod, the parallel fibers of second hosel section layer are juxtaposed to the parallel fibers in the first hosel section layer and disposed at an angle substantially between approximately thirty degrees and approximately ninety degrees measured from the longitudinal axis of the base rod, and the parallel fibers of the third hosel section layer are substantially parallel to the longitudinal axis of the base rod.

6. A golf club shaft as claimed in claim 5, wherein the first, second and third hosel section layers define respective lengths, the length of the first hosel section layer is substantially greater than the length of the second hosel section layer, the length of the second hosel section layer is substantially greater than the length of the third hosel section layer, the length of the third hosel section layer is equal to the hosel section length, and portions of the first and second hosel section layers extend beyond the first end of the hosel section to form a flare section.

7. A golf club shaft as claimed in claim 6, wherein the length of the first hosel section layer is substantially equal to six inches, the length of the second hosel section layer is substantially equal to five inches, and the length of the third hosel section layer is substantially equal to four inches.

8. A golf club shaft as claimed in claim 1, wherein hosel section length is at least one-half inch greater than the hosel recess length.

9. A golf club shaft as claimed in claim 8, wherein hosel section length is at least twice the hosel recess length.

10. A golf club shaft as claimed in claim 1, wherein the second end of the hosel section and the second longitudinal end of the base rod are flush with one another.

11. A golf club shaft as claimed in claim 1, further comprising:

a flare section around the base rod and having a first end abutting the first end of the hosel section and a second end located between the first end of the hosel section and the first longitudinal end of the base rod, the flare section defining a decreasing thickness such that the thickness of the first end of the flare section is greater than the thickness of the second end of the flare section.

12. A golf club shaft as claimed in claim 1, wherein the base rod defines a decreasing outer diameter and tapers from a largest diameter at the first longitudinal end to a smallest diameter at the second longitudinal end.

13. A golf club, comprising:

a club head including a hosel having a recess formed therein, the recess defining a hosel recess length; and a shaft including a base rod defining a grip portion associated with a first longitudinal end, and a club head portion associated with a second longitudinal end, and a hosel section extending radially outwardly from a portion of the base rod, the hosel section defining a first end located between the first and second longitudinal ends of the base rod and a second end located substantially adjacent to the second longitudinal end of the base rod, the first and second ends of the hosel section defining a hosel section length therebetween, the hosel section length being substantially uniform predetermined thickness over the hosel section length, and the hosel section length being substantially greater than the hosel recess length.

14. A golf club as claimed in claim 13, wherein the base rod comprises a plurality of base rod layers of a composite of a polymer reinforced internally by parallel elongate fibers and the hosel section comprises at least one hosel section layer of a composite of a polymer reinforced internally by parallel elongate fibers.

15. A golf club as claimed in claim 14, wherein the parallel elongate fibers in one base rod layer extend in a substantially different direction than the parallel elongate fibers in an adjacent base rod layer.

16. A golf club as claimed in claim 14, wherein the hosel section comprises a plurality of hosel section layers and the parallel elongate fibers in one hosel section layer extend in a substantially different direction than the parallel elongate fibers in an adjacent hosel section layer.

17. A golf club as claimed in claim 16, wherein the base rod defines a longitudinal axis, the hosel section comprises at least first, second and third hosel section layers, the parallel fibers of the first hosel section layer are disposed at an angle substantially between approximately thirty degrees and approximately ninety degrees measured from the longitudinal axis of the base rod, the parallel fibers of second hosel section layer are juxtaposed to the parallel fibers in the first hosel section layer and disposed at an angle substantially between approximately thirty degrees and approximately ninety degrees measured from the longitudinal axis of the base rod, and the parallel fibers of the third hosel section layer are substantially parallel to the longitudinal axis of the base rod.

18. A golf club as claimed in claim 17, wherein the first, second and third hosel section layers define respective lengths, the length of the first hosel section layer is substantially greater than the length of the second hosel section layer, the length of the second hosel section layer is substantially greater than the length of the third hosel section layer, the length of the third hosel section layer is equal to the hosel section length, and portions of the first and second hosel section layers extend beyond the first end of the hosel section to form a flare section.

19. A golf club as claimed in claim 18, wherein the length of the first hosel section layer is substantially equal to six inches, the length of the second hosel section layer is substantially equal to five inches, and the length of the third hosel section layer is substantially equal to four inches.

20. A golf club as claimed in claim 13, wherein hosel section length is at least one-half inch greater than the hosel recess length.

21. A golf club as claimed in claim 20, wherein hosel section length is at least twice the hosel recess length.

22. A golf club as claimed in claim 13, wherein the second end of the hosel section and the second longitudinal end of the base rod are flush with one another.

23. A golf club as claimed in claim 13, further comprising:

a flare section around the base rod and having a first end abutting the first end of the hosel section and a second end located between the first end of the hosel section and the first longitudinal end of the base rod, the flare section defining a decreasing thickness such that the thickness of the first end of the flare section is greater than the thickness of the second end of the flare section.

24. A golf club as claimed in claim 13, wherein the base rod defines a decreasing outer diameter and tapers from a largest diameter at the first longitudinal end to a smallest diameter at the second longitudinal end.

25. A method of manufacturing a golf club shaft for use with a golf club head, the golf club head including a hosel having a recess formed therein, the recess defining a hosel recess length, the method comprising the steps of:

providing a mandrel;

forming a base rod on the mandrel by applying a plurality of base rod layers of a composite of a polymer reinforced internally by parallel elongate fibers such that the base rod defines a grip portion associated with a first longitudinal end, and a club head portion associated with a second longitudinal end;

forming a hosel section around a portion of the base rod by applying at least one hosel section layer of a composite of a polymer reinforced internally by parallel elongate fibers such that the hosel section defines a first end located between the first and second longitudinal ends of the base rod and a second end located substantially adjacent to the second longitudinal end of the base rod, the first and second ends of the hosel section defining a hosel section length therebetween, the hosel section having a substantially uniform predetermined thickness over the hosel section length, and the hosel section length being substantially greater than the hosel recess length.

26. A method as claimed in claim 25, wherein the step of forming a base rod comprises applying a plurality of base rod layers such that the parallel elongate fibers in one base rod layer extend in a substantially different direction than the parallel elongate fibers in an adjacent base rod layer.

27. A method as claimed in claim 26, wherein the step of forming a hosel section comprises applying a plurality of hosel section layers such that the parallel elongate fibers in one hosel section layer extend in a substantially different direction than the parallel elongate fibers in an adjacent hosel section layer.

28. A method as claimed in claim 27, wherein the base rod defines a longitudinal axis and the step of forming the hosel section comprises the steps of applying a first hosel section layer such that the parallel fibers of the first hosel section layer are disposed at an angle substantially between approximately thirty degrees and approximately ninety degrees measured from the longitudinal axis of the base rod, applying a second hosel section layer such that the parallel fibers of second hosel section layer are juxtaposed to the parallel fibers in the first hosel section layer and disposed at an angle substantially between approximately thirty degrees and approximately ninety degrees measured from the longitudinal axis of the base rod, and applying a third hosel section layer such that the parallel fibers of the third hosel section layer are substantially parallel to the longitudinal axis of the base rod.

29. A method as claimed in claim 28, wherein the first, second and third hosel section layers define respective lengths, the length of the first hosel section layer is substantially greater than the length of the second hosel section layer, the length of the second hosel section layer is substantially greater than the length of the third hosel section layer, the length of the third hosel section layer is equal to the hosel section length, and portions of the first and second hosel section layers extend beyond the first end of the hosel section to form a flare section.

30. A method as claimed in claim 25, wherein hosel section length is at least one-half inch greater than the hosel recess length.

31. A method as claimed in claim 30, wherein hosel section length is at least twice the hosel recess length.

32. A method as claimed in claim 25, wherein the step of forming a hosel section comprises forming the hosel section such that the second end of the hosel section and the second longitudinal end of the base rod are flush with one another.

33. A method as claimed in claim 25, wherein the step of providing a mandrel comprises providing a mandrel defining a decreasing diameter which tapers from a largest diameter at one longitudinal end to a smallest diameter at the other second longitudinal end.

* * * * *